US006148627A

United States Patent [19]

Reason et al.

[11] Patent Number: 6,148,627

[45] Date of Patent: Nov. 21, 2000

[54] HIGH ENGINE COOLANT TEMPERATURE CONTROL

[76] Inventors: John Robert Reason, 4356 Loveland Dr., Liverpool, N.Y. 13090; Joao Eduardo Navarro de Andrade, 6112 Cobblestone Dr. #1-11, Cicero, N.Y. 13039

[21] Appl. No.: 09/277,472

[22] Filed: Mar. 26, 1999

[51] Int. Cl.[7] ..... F25B 41/04

[52] U.S. Cl. ..... 62/217; 62/230; 62/323.1

[58] Field of Search ..... 62/230, 217, 323.1, 62/323.3, 222, 223, 209, 210, 211

[56] References Cited

U.S. PATENT DOCUMENTS

| | | | |
|---|---|---|---|
| 3,220,211 | 11/1965 | Nordquest | 62/217 |
| 4,134,272 | 1/1979 | Reimann | 62/115 |
| 4,735,055 | 4/1988 | Taylor et al. | 62/115 |
| 4,903,495 | 2/1990 | Howland et al. | 62/81 |
| 5,067,556 | 11/1991 | Fudono et al. | 165/29 |
| 5,291,745 | 3/1994 | Hanson | 62/89 |
| 5,546,756 | 8/1996 | Ali | 62/204 |
| 5,557,938 | 9/1996 | Hanson et al. | 62/126 |
| 5,572,879 | 11/1996 | Harrington et al. | 62/230 X |
| 5,598,718 | 2/1997 | Freund et al. | 62/238.6 |
| 5,625,276 | 4/1997 | Scott et al. | 322/24 |
| 5,626,027 | 5/1997 | Dormer et al. | 62/175 |
| 5,628,205 | 5/1997 | Rockenfeller et al. . | |
| 5,661,378 | 8/1997 | Hapeman . | |
| 5,715,704 | 2/1998 | Cholkeri et al. . | |
| 5,771,703 | 6/1998 | Rajendran . | |
| 5,780,998 | 6/1998 | Scott et al. | 322/46 |
| 5,798,577 | 8/1998 | Lesesky et al. | 307/10.7 |
| 5,867,998 | 2/1999 | Guertin | 62/225 |
| 5,907,957 | 6/1999 | Lee et al. | 62/217 |

*Primary Examiner*—Harry B. Tanner
*Attorney, Agent, or Firm*—Niro Scavone Haller & Niro

[57] ABSTRACT

An system and method for monitoring and limiting high power and overheating engine conditions in a transport refrigeration unit is disclosed. The system provides a microprocessor control which monitor the engine coolant temperature to determine whether it exceeds a predetermined limit. If the engine coolant temperature exceeds that limit, the control sends a control signal which restricts or closes the suction modulation valve of the transport refrigeration system, restricting the mass flow rate of the system and thereby reducing the power draw on the engine. The system further provides a continued monitoring process for further restricting or closing the suction modulation valve in the event of continued high engine coolant temperatures, and for gradually opening the suction modulation valve and increasing the maximum current draw on the engine once the engine coolant temperature sinks below its predetermined limit.

4 Claims, 3 Drawing Sheets

HIGH ENGINE COOLANT TEMPERATURE CONTROL

FIELD OF THE INVENTION

The field of the present invention relates to control systems for transport refrigeration systems. More specifically, the present invention is directed towards facilitating the operation of a diesel engine powering a transport refrigeration unit in extreme operating conditions.

DESCRIPTION OF THE PRIOR ART

A common problem with transporting perishable items is that often such items must be maintained within strict temperature limits, regardless of potentially extreme operating conditions required by a high ambient temperature and/or other factors. These extreme conditions can cause an excessive power draw from the diesel engine powering the system, thus potentially causing unwanted system shutdowns or even adversely impacting the useful life of the engine. In order to prevent this problem, and its associated increased costs for maintenance and replacement of the engine, others in the field have attempted to control refrigeration transport systems by forcing the engine into low speed if the coolant temperature of the engine is above a specified limit. However, this kind of control has no control algorithm in place to optimize the reduction of the power supplied to the refrigeration system, i.e., a system which could maintain the maximum refrigeration capability of the system while preventing any unnecessary system shut downs. As a result, the severe power reduction resulting from the low speed condition in such a "two step" (engine control could result in the unnecessary reduction in refrigeration capacity and the resulting endangerment of the perishable load.

In short, prior devices may not provide sufficient protection against engine oveheating conditions, while simultaneously ensuring the safety of the load and the optimization of refrigeration capacity. There is a need for a control system in refrigerated transport systems which prevents sustained high engine coolant temperature conditions while permitting a more optimal refrigeration capacity of system.

SUMMARY OF THE INVENTION

The apparatus and control method of this invention provides a refrigeration unit for a transport system having a diesel operation mode. The system includes a sensor for monitoring the engine coolant temperature. If the sensor indicates that the engine coolant temperature has risen above the maximum, timed engine coolant temperature for more than a preselected time interval (e.g., one minute), then a control signal actuated by the microprocessor control of the system reduces the maximum allowable generator current setting by one amp. The microprocessor control of the present system controls power consumption indirectly, i.e., through the limitation of the maximum electrical current drawn by the system. This change is enabled by restricting or closing the suction modulation valve, thus restricting the mass flow of refrigerant in the system (and thus limiting the need or requirement for cooling of the engine).

The microprocessor controlled system of the present invention further includes multiple control steps to prevent sustained high engine coolant temperatures. In other words, if one minute after the suction modulation valve has been restricted the engine coolant temperature is still above the maximum timed engine coolant temperature, the maximum allowable generator current setting is further reduced by five amps. Again, this control can be actuated through the further restriction of the suction modulation valve. This further restricted setting, when actuated, is most preferably maintained for a minimum period of time (e.g., ten minutes). If after this period of time the engine coolant temperature is still above its preselected limit, the microprocessor control triggers a high coolant alarm and holds the low current draw conditions until the coolant temperature falls below the maximum timed engine coolant temperature. Once the engine coolant temperature falls below the maximum timed engine coolant setting, the microprocessor control sends control signals gradually reopening the suction modulation valve, thus increasing the mass flow and current draw, and preferably restoring the original maximum allowable generator, current setting at a rate of one amp per minute.

Accordingly, one object of the present invention is to provide a microprocessor control for the regulation of engine coolant temperature.

It is a further object of the invention to provide a microprocessor control for controlling engine coolant temperature through adjustment of the mass flow rate of refrigerant in the transport refrigeration system powered by the engine.

It is another object of the present invention to provide a multistep adjustment of the mass flow rate of the refrigerant of the mass transport rate of a refrigeration transport system, thereby, optimizing the power draw on the engine in order to minimize system shut-downs and unnecessary wear on the engine.

These and other objects, features, and advantages of the present invention will become more apparent in light of the following detailed description of a best mode embodiment thereof, and as illustrated in the accompanying drawings.

DETAILED DESCRIPTION OF THE INVENTION

The invention that is the subject of the present application is one of a series of applications dealing with transport refrigeration system design and control, the other copending applications including: "Voltage Control Using Engine Speed"(U.S. patent application Ser. No. 09/277,507); "Economy Mode For Transport Refrigeration Units" (U.S. Pat. No. 6,044,651); "Compressor Operating Envelope Management" (U.S. patent application Ser. No. 09/277,473); "High Engine Coolant Temperature Control"(U.S. patent application Ser. No. 09/277,472); "Generator Power Management" (U.S. patent application Ser. No. 09/277,509);and "Electronic Expansion Valve Control Without Pressure Sensor Reading" (U.S. patent application Ser. No. 09/277,333) all of which are assigned to the assignees of the present invention and which are hereby incorporated herein by reference. These inventions are most preferably designed for use in transportation refrigeration systems of the type described in copending applications entitled: "Transport Refrigeration Unit With Non-Synchronous Generator Power System;" Electrically Powered Trailer Refrigeration Unit With Integrally Mounted Diesel Driven Permanent Magnet Generator;" and "Transport Refrigeration Unit With Synchronous Generator Power System," each of which were invented by Robert Chopko, Kenneth Barrett, and James Wilson, and each of which were likewise assigned to the assignees of the present invention. The teachings and disclosures of these applications are likewise incorporated herein by reference.

Figure 1:
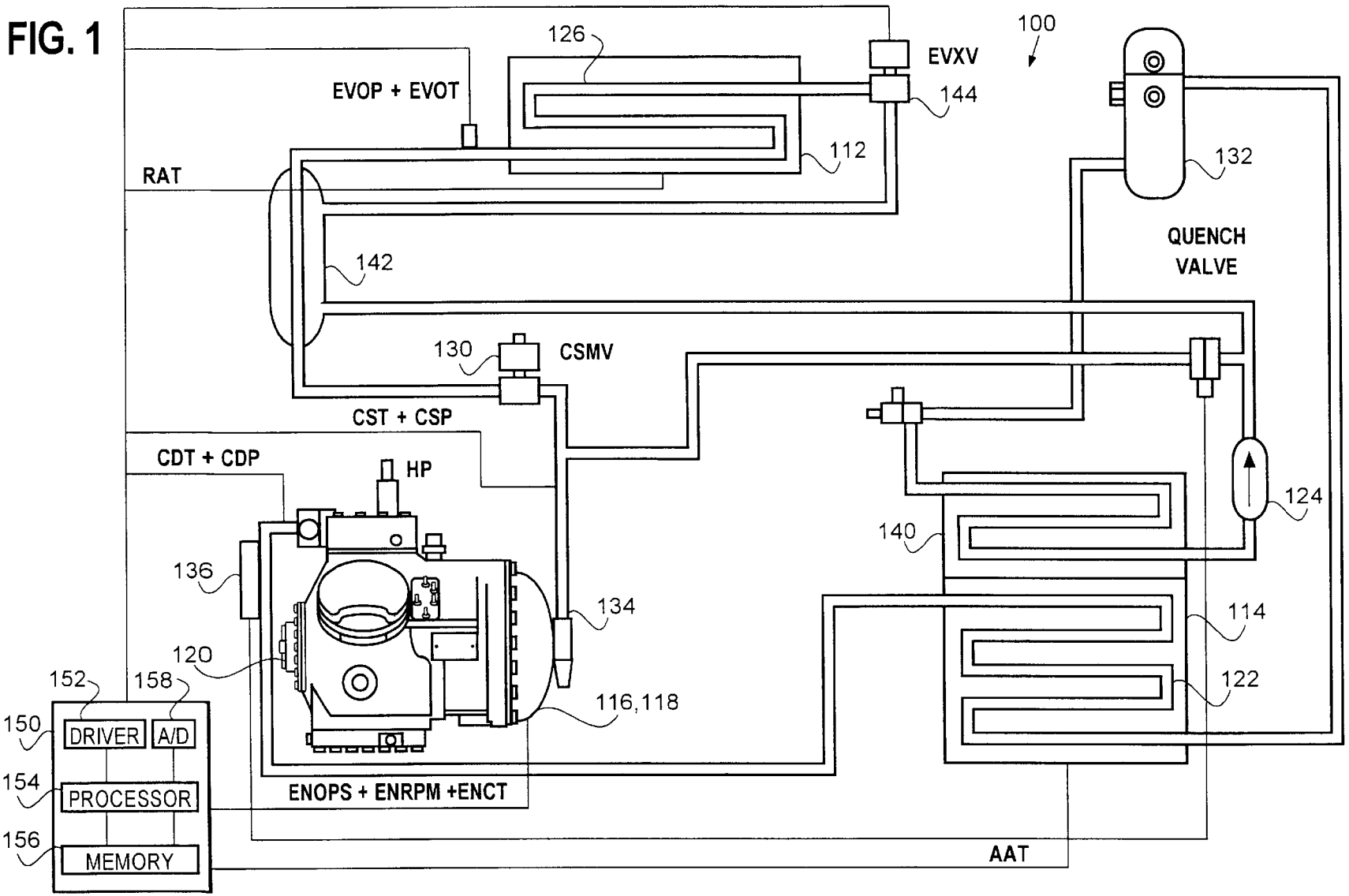
FIG. 1 shows a schematic of the transport refrigeration system of the present invention.

FIG. 1 illustrates a schematic representation of the transport refrigeration system 100 of the present invention. The refrigerant (which, in its most preferred embodiment is R404A) is used to cool the box air (i.e., the air within the container or trailer or truck) of the refrigeration transport system 100. is first compressed by a compressor 116, which is driven by a motor 118, which is most preferably an integrated electric drive motor driven by a synchronous generator (not shown) operating at low speed (most preferably 45 Hz) or high speed (most preferably 65 Hz). Another preferred embodiment of the present invention, however, provides for motor 118 to be a diesel engine, most preferably a four cylinder, 2200 cc displacement diesel engine which preferably operates at a high speed (about 1950 RPM) or at low speed (about 1350 RPM). The motor or engine 118 most preferably drives a 6 cylinder compressor 116 having a displacement pf 600 cc, the compressor 116 further having two unloaders, each for selectively unloading a pair of cylinders under selective operating conditions. In the compressor, the (preferably vapor state) refrigerant is compressed to a higher temperature and pressure. The refrigerant then moves to the air-cooled condenser 114, which includes a plurality of condenser coil fins and tubes 122, which receiver air, typically blown by a condenser fan (not shown). By removing latent heat through this step, the refrigerant condenses to a high pressure/high temperature liquid and flow to a receiver 132 that provides storage for excess liquid refrigerant during low temperature operation. From the receiver 132, the refrigerant flows through subcooler unit 140, then to a filter-drier 124 which keeps the refrigerant clean and dry, and then to a heat exchanger 142, which increases the refrigerant subcooling.

Finally, the refrigerant flows to an electronic expansion valve 144 (the "EXV"). As the liquid refrigerant passes through the orifice of the EXV, at least some of it vaporizes. The refrigerant then flows through the tubes or coils 126 of the evaporator 112, which absorbs heat from the return air (i.e., air returning from the box) and in so doing, vaporizes the remaining liquid refrigerant. The return air is preferably drawn or pushed across the tubes or coils 126 by at least one evaporator fan (not shown). The refrigerant vapor is then drawn from the exchanger 112 through a suction modulation valve (or "SMV") back into the compressor.

Figure 2:
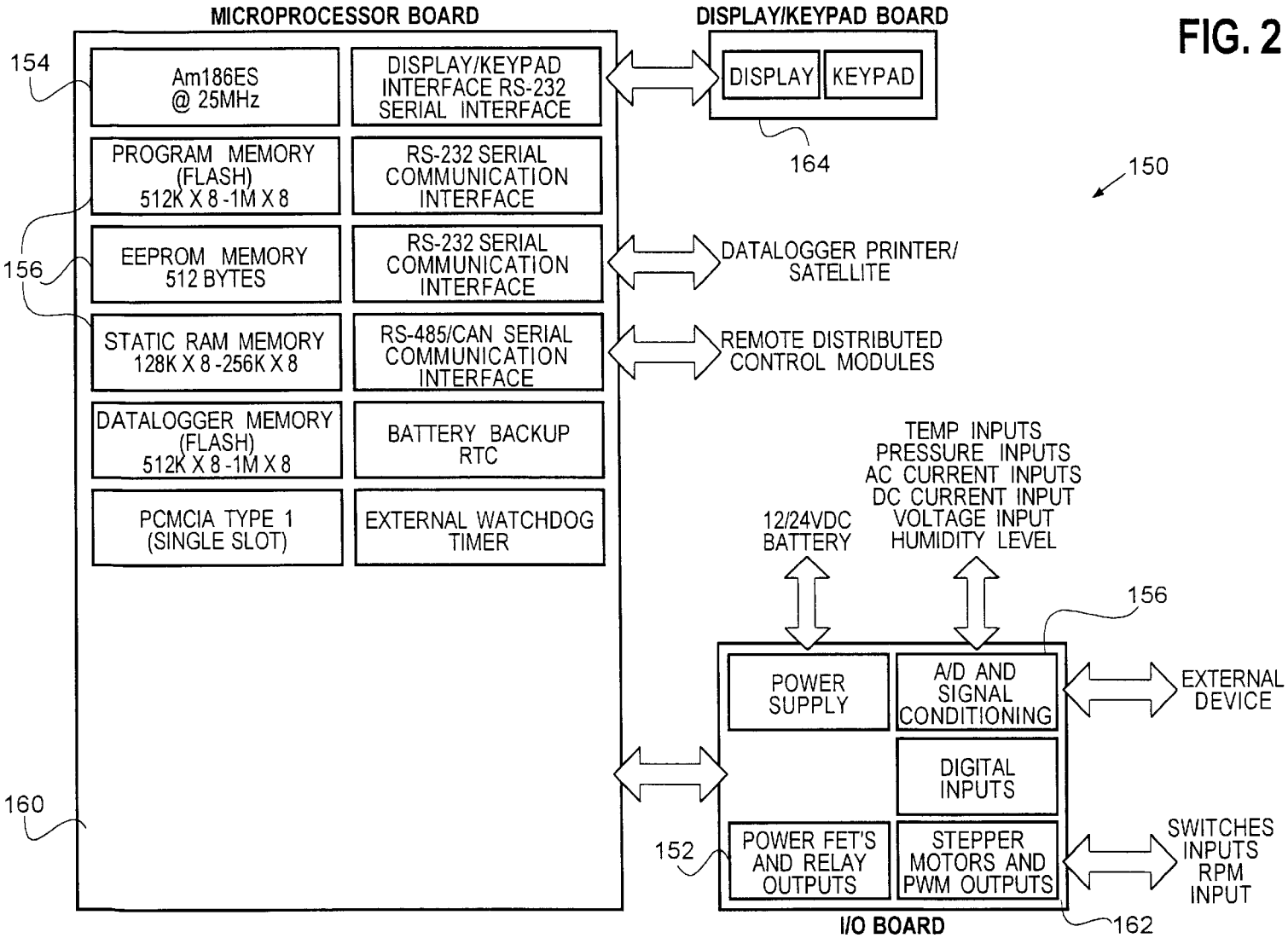
FIG. 2 shows a block schematic of a first preferred embodiment of a controller of the present invention.
Figure 2A:
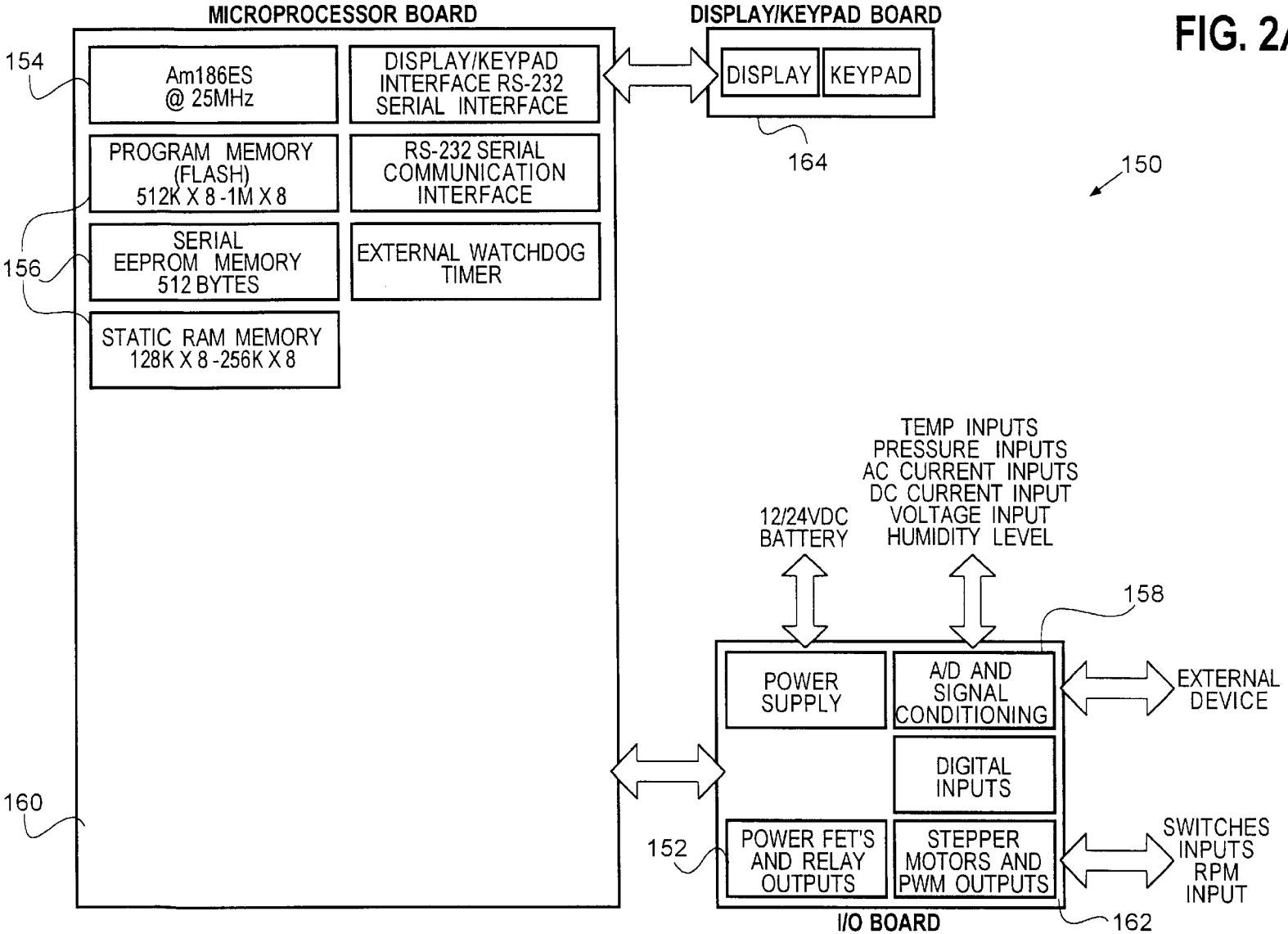
FIG. 2*a* shows a block schematic of a second preferred embodiment of a controller of the present invention.

Many of the points in the transport refrigeration system are monitored and controlled by a controller 150. As shown in FIGS. 2 and 2A Controller 150 preferably includes a microprocessor 154 and is associated memory 156. The memory 156 of controller 150 can contain operator or owner preselected, desired values for various operating parameters within the system, including, but not limited to temperature set point for various locations within the system 100 or the box, pressure limits, current limits, engine speed limits, and any variety of other desired operating parameters or limits with the system 100. Controller 150 most preferably includes a microprocessor board 160 that contains microprocessor 154 and memory 156, an input/output (I/O) board 162, which contains an analog to digital converter 156 which receives temperature inputs and pressure inputs from various points in the system, AC current inputs, DC current inputs, voltage inputs and humidity level inputs. In addition, I/O board 162 includes drive circuits or field effect transistors ("FETs") and relays which receive signals or current from the controller 150 and in turn control various external or peripheral devices in the system 100, such as SMV 130, EXV 144 and the speed of engine 118 through a solenoid (not shown).

Among the specific sensors and transducers most preferably monitored by controller 150 includes: the return air temperature (RAT) sensor which inputs into the processor 154 a variable resistor value according to the evaporator return air temperature; the ambient air temperature (AAT) which inputs into microprocessor 154 a variable resistor value according to the ambient air temperature read in front of the condenser 114; the compressor suction temperature (CST) sensor; which inputs to the microprocessor a variable resistor value according to the compressor suction temperature; the compressor discharge temperature (CDT) sensor, which inputs to microprocessor 154 a resistor value according to the compressor discharge temperature inside the cylinder head of compressor 116; the evaporator outlet temperature (EVOT) sensor, which inputs to microprocessor 154 a variable resistor value according to the outlet temperature of, evaporator 112; the generator temperature (GENT) sensor, which inputs to microprocessor 154 a resistor value according to the generator temperature; the engine coolant temperature (ENCT) sensor, which inputs to microprocessor 154 a variable resistor value according to the engine coolant temperature of engine 118; the compressor suction pressure (CSP) transducer, which inputs to microprocessor 154 a variable voltage according to the compressor suction value of compressor 116; the compressor discharge pressure (CDP) transducer, which inputs to microprocessor 154 a variable voltage according to the compressor discharge value of compressor 116; the evaporator outlet pressure (EVOP) transducer which inputs to microprocessor 154 a variable voltage according to the evaporator outlet pressure or evaporator, 112; the engine oil pressure switch (ENOPS), which inputs to microprocessor 154 an engine oil pressure value from engine 118; direct current and aLternating current sensors (CT1 and CT2, respectively), which input to microprocessor 154 a variable voltage values corresponding to the current drawn by the system 100 and an engine RPM (ENRPM) transducer, which inputs to microprocessor 154 a variable frequency according to the engine RPM of engine 118.

In the present invention, the ENCT value received into controller 150 through I/O board 162 is compared to a maximum timed engine coolant temperature value (stored in memory 156) for more than a preselected period of time (e.g., one minute), then processor 154 reduces the maximum allowable generator current setting (again, stored in memory 156) by a predetermined amount (e.g., one amp). Since the system 100 controls power consumption indirectly, through the limitation of the maximum current limit drawn by the system, this step by the processor 154 of controller 150 causes SMV 130 to close, thus restricting the mass flow of refrigerant and limiting power consumption. If, after a preselected period of time, (e.g., one minute), the ENCT value received into controller 150 is still greater than the value stored in memory 156, then controller 150 reduces the maximum allowable generator current value (as stored in memory 156) by a preselected amount (e.g., by a further five amps), thus causing further closure of SMV 130. This reduced setting is preferably maintained for a minimum longer time period (e.g., 10 minutes).

If after this period the ENCT value received by controller 150 is still above the limit stored in memory 156, the controller 150 triggers a high engine coolant alarm temperature and displays that alarm to the operator through display 164. The controller further holds the low current setting until the engine coolant temperature falls below the maximum timed engine coolant temperature value stored in memory 156. If the ENCT value input into controller falls below the maximum timed engine coolant temperature stored in memory 156, then the processor of controller 150 operates to restore the original maximum allowable current setting at a rate of one amp per minute, thus maximizing the refrigeration capacity once more without recreating the undesirable engine coolant temperature conditions again.

It will be appreciated by those skilled in the art that various changes, additions, omissions, and modifications can be made to the illustrated embodiments without departing from the spirit of the present invention. All such modifications and changes are intended to be covered by the following claims.

We claim:

1. A process for monitoring and limiting high power and overheating engine conditions in a transport refrigeration unit, said process comprising the steps of:

i monitoring the engine coolant temperature within said transport refrigeration unit;

ii comparing said engine coolant temperature to a predetermined limit within the microprocessor of said transport refrigeration unit;

iii selectively actuating the suction modulation valve in response to coolant temperatures above said predetermined limit, thereby limiting the maximum current draw in said transport refrigeration unit and decreasing load on the engine.

2. The process for monitoring and limiting high power and overheating engine conditions of claim 1, comprising the further steps of:

iv further monitoring the engine coolant temperature within said transport refrigeration unit;

v comparing said engine coolant temperature to said predetermined limit within the microprocessor of said transport refrigeration unit;

vi selectively further actuating the suction modulation valve in response to coolant temperatures remaining above said predetermined limit for a preselected period of time, thereby limiting the maximum current draw in said transport refrigeration unit and decreasing load on the engine.

3. The process for monitoring and limiting high power and overheating engine conditions of claim 2, comprising the further steps of:

vii still further monitoring the engine coolant temperature within said transport refrigeration unit;

viii comparing said engine coolant temperature to said predetermined limit within the microprocessor of said transport refrigeration unit;

ix selectively opening the suction modulation valve in response to coolant temperatures dropping below said predetermined limit, thereby gradually restoring the maximum current draw in said transport refrigeration unit and increasing the system load on the engine.

4. A system for monitoring and limiting high power and overheating engine conditions for an engine providing power to a transport refrigeration unit, said system comprising:

i a sensor for monitoring engine coolant temperature;

ii a controller operably connected to said sensor, said controller having memory for storing a preselected engine coolant temperature limit, said controller further having a processor for comparing the engine coolant temperature received from said sensor to said preselected engine coolant temperature limit, and said controller further generating a control signal in the event of said engine coolant temperature exceeding said preselected engine coolant temperature limit;

iii a suction modulation valve operatively connected to said controller, said suction modulation valve selectively opening in response to said control signal from said controller.

* * * * *

UNITED STATES PATENT AND TRADEMARK OFFICE

CERTIFICATE OF CORRECTION

PATENT NO : 6,148,627

DATED : November 21, 2000

INVENTOR(S) : John Robert Reason et al.

It is certified that error appears in the above-identified patent and that said Letters Patent are hereby corrected as shown below:

On title page, item 73 insert --Carrier Corporation--

Signed and Sealed this

Eighth Day of May, 2001

*Attest:*

Nicholas P. Godici

NICHOLAS P. GODICI

*Attesting Officer*

*Acting Director of the United States Patent and Trademark Office*